United States Patent [19]

Cole

[11] Patent Number: 4,972,898

[45] Date of Patent: Nov. 27, 1990

[54] METHOD OF FORMING A PISTON CONTAINING A CAVITY

[75] Inventor: Andrew T. Cole, Rugby, England

[73] Assignee: T & N Technology Limited, Rugby, England

[21] Appl. No.: 360,300

[22] Filed: Jun. 2, 1989

[30] Foreign Application Priority Data

Jun. 23, 1988 [GB] United Kingdom ..... 8814916

[51] Int. Cl.[5] ..... B22D 18/02; B22D 19/00

[52] U.S. Cl. ..... 164/98; 164/120

[58] Field of Search ..... 164/97, 98, 80, 120, 164/132

[56] References Cited

U.S. PATENT DOCUMENTS

| | | | |
|---|---|---|---|
| B 318,195 | 1/1975 | Umehara et al. . | |
| 2,737,456 | 3/1956 | Haller | 164/80 X |
| 4,008,051 | 2/1977 | Cadle | 164/98 X |
| 4,588,551 | 5/1986 | Iijima et al. . | |
| 4,651,631 | 3/1987 | Avezou | 164/97 X |
| 4,667,727 | 5/1987 | Barlow et al. | 164/97 |
| 4,712,600 | 12/1987 | Hamajima et al. | 164/97 |
| 4,776,075 | 10/1988 | Kawabata et al. | 164/132 X |
| 4,810,462 | 3/1989 | Hsu et al. | 164/80 X |

FOREIGN PATENT DOCUMENTS

| | | | |
|---|---|---|---|
| 0261726A | 3/1988 | European Pat. Off. . | |
| WO81/02126 | 8/1981 | PCT Int'l Appl. . | |
| WO84/02096 | 6/1984 | PCT Int'l Appl. | 164/98 |
| 1273815 | 5/1972 | United Kingdom . | |
| 1574084 | 9/1980 | United Kingdom . | |
| 2123727A | 2/1984 | United Kingdom | 164/98 |

*Primary Examiner*—Richard K. Seidel
*Assistant Examiner*—J. Reed Batten, Jr.
*Attorney, Agent, or Firm*—William R. Hinds

[57] ABSTRACT

A porous body is formed around an element which has the shape of the desired cavity and the body is heated to a temperature such that the element melts and infiltrates the porous body at least in the immediate vicinity of the resulting cavity. The article may then, for example, be incorporated into a piston for an internal combustion engine so as to form a cavity in the crown region thereof.

5 Claims, 2 Drawing Sheets

METHOD OF FORMING A PISTON CONTAINING A CAVITY

Figure 1:
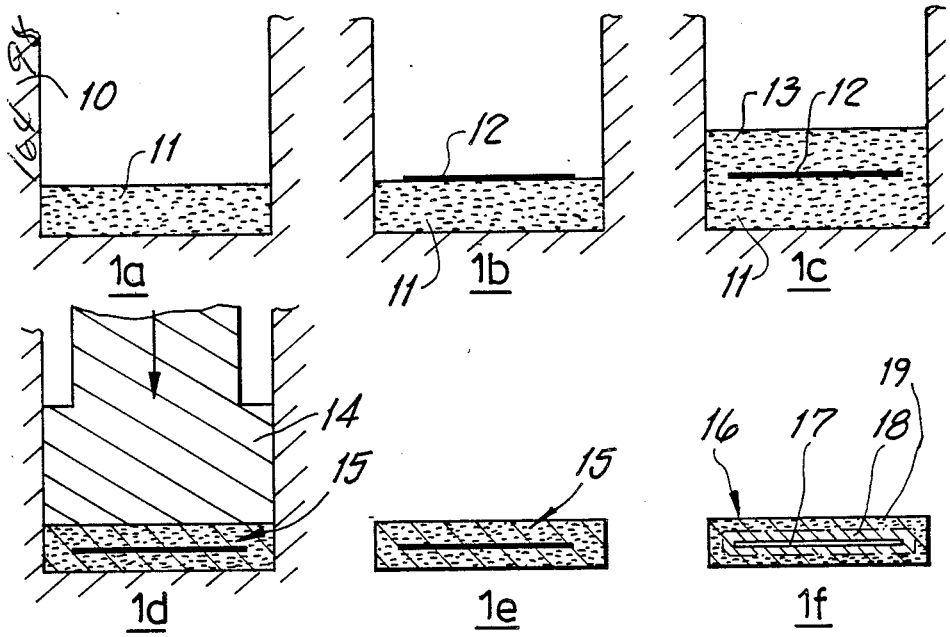

The present invention relates generally to the production of a cavity in a piston and particularly though not exclusively, to such a cavity or cavities in a piston for an internal combustion engine.

Pistons for some internal combustion engines may desirably have a cavity in the crown region thereof. Such cavities may be for the purpose of increasing the temperature in the combustion region to improve efficiency, for example, or may be to allow the circulation of cooling oil around the crown region.

One method of achieving a cavity is described in European patent application No. 0261 726 where a crown component is fabricated to include a cavity and is then attached to the remainder of the piston body. This method tends to be complex and, therefore, uneconomic for all but the most demanding of applications.

US-4712600 describes a method of producing a piston having a cavity therein by encasting a precursor member having the shape of the desired cavity and which is subsequently removed by melting out. This method is also expensive in that several additional process operations are required together with the need to insert and fasten plugs after the precursor member has been removed in order to form a sealed cavity.

I have now found a method of producing a sealed cavity in a body and which body may subsequently be incorporated into an article, such as a piston by known techniques.

According to a first aspect of the present invention, a method of forming a cavity in a piston comprises the steps of incorporating an element having substantially the desired shape of the cavity within a ferrous powder mass, compacting the powder mass to a desired density to form a porous body, heating the porous body at a temperature greater than the melting temperature of the contained element such that the porous body adjacent the element becomes infiltrated with and sealed by the material of the element to leave a sealed residual cavity in the body and to leave some residual porosity, and then incorporating said cavity-containing body into a piston by a pressure casting technique to infiltrate at least part of the residual porosity of the body.

In one embodiment of the present invention the article is a piston for an internal combustion engine or compressor.

The element may comprise a single metal or alloy such that on melting the residual cavity assumes substantially the shape of the element. The element may, however, be a composite element where only a part melts at the desired temperature.

The porous body may be a ferrous based metal made by powder metallurgy (PM) techniques. The porous body may be formed from a prealloyed ferrous powder or have some or all of its alloying additions in the form of separate elemental powder additions, for example, in the form of an iron, copper and tin powder mixture. Another example of a suitable material from which to make the body of the article may be austenitic stainless steel.

The shaped element may be formed by any metal working method such as casting, forging, stamping, for example or may itself be a PM article.

Where the body is a ferrous-based material the shaped element may be made from copper or a copper-based alloy, for example. In one embodiment of the present invention the shaped element may comprise a pressing of a mixture of copper and tin powders. Using such a mixture negates the expansion characteristic of copper in that it may otherwise tend to crack the body of the article in which it is contained.

The shaped element may also contain inert filler material such as ceramic powder or another metal in order to control the volume of metal available for the infiltration of the article in the vicinity of the cavity.

The PM route, by means of density control may alternatively or additionally, with the use of inert fillers, be used to control the available metal volume of the element.

The cavity containing body may be incorporated into the piston during a casting operation. Where it is desirable to completely infiltrate the residual porosity of the body, a pressure casting technique such as squeeze-casting, for example, is preferably used. The cavity within the body remains unfilled with the piston alloy as a result of the infiltrated metal of the shaped element surrounding the cavity and sealing it against the applied casting pressure. A strong bond is obtained between the alloy, which may be an aluminum alloy, and the cavity containing body due to the infiltration of remaining porosity.

Figure 2:
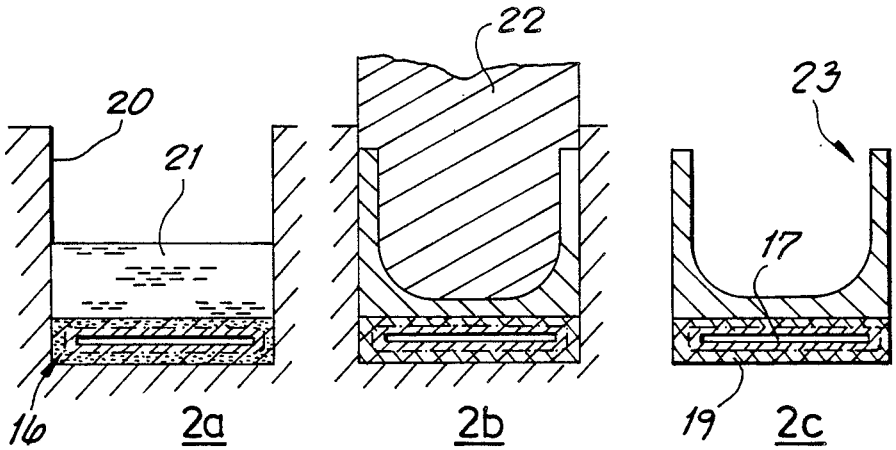
Figure 3A:
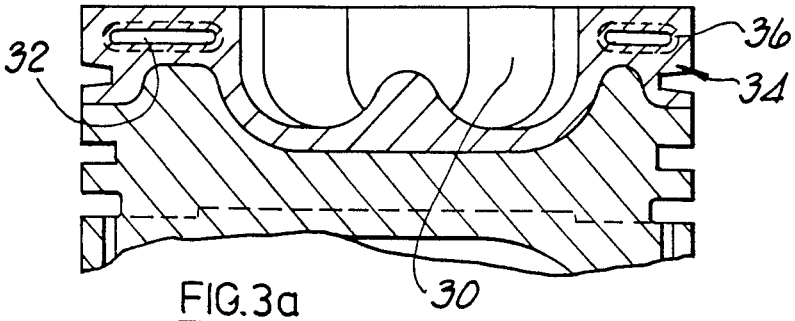
Figure 3B:
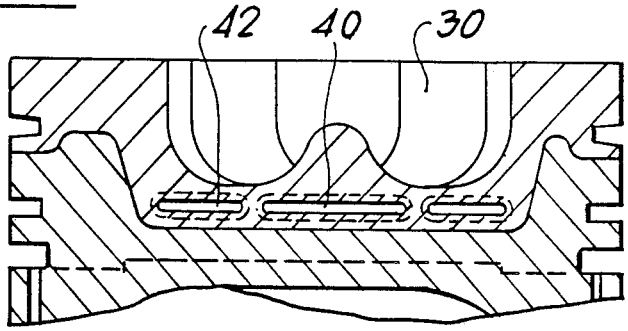
Figure 3C:
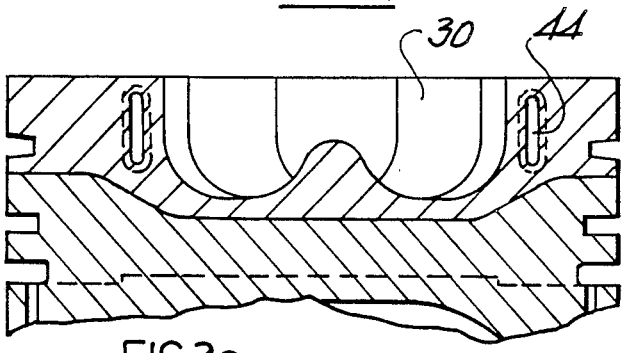
Figure 4A:
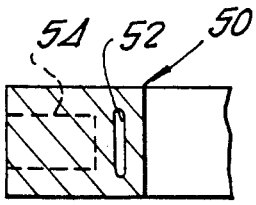
Figure 4B:
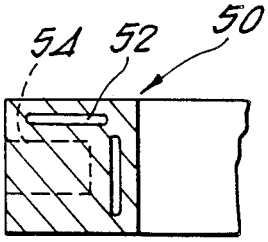
Figure 4C:
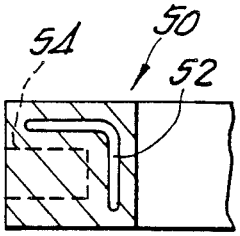

In order that the present invention may be more fully understood, examples will now be described by way of illustration only with reference to the accompanying drawings, of which:

FIGS. 1 (*a*) to (*f*) show a schematic sequence in the production of a body having a sealed cavity according to the present invention;

FIGS. 2(*a*) to (*c*) show a schematic sequence where the body of FIG. 1(*f*) is being incorporated into a piston crown;

FIGS. 3(*a*) to (*c*) show alternative geometries of cavity which may be employed in a piston crown; and FIGS. 4 (*a*) to (*c*) which show piston ring carrier bodies having cavities contained therein.

Referring now to FIGS. 1(*a*) to (*f*) and 2(*a*) to (*c*) and where the same features are denoted by common reference numerals.

A metal powder pressing die 10 of 74 mm diameter was filled to a depth of 14 mm with 304L austenitic stainless steel powder 11 of 150 micrometers sieve fraction (FIG. 1(*a*)). A copper disc 12 of 60 mm diameter and 1 mm thickness was placed centrally on the powder 11 (FIG.1(*b*)). A second 14 mm layer of 304L powder 13 was added (FIG.1(*c*)). The powder and disc were then subjected to a load of 200 tonnes by a pressing ram 14 (FIG.1(*d*). This produced a green component 15 of 15 mm thickness which was ejected from the die (FIG.1(*e*)). The green component was then sintered in an atmosphere of 75% $N_2$ and 25% $H_2$ at 1100° C. for 20 minutes to produce a body 16 having a sealed disc shaped cavity 17. The immediate vicinity 18 surrounding the cavity 17 was infiltrated with copper whilst the outer surfaces 19 remained porous.

The body 16 was preheated in an oven to 400° C. and placed in the female part 20 of a 75 mm diameter, crown-down squeeze-casting piston die. Molten LO-EX (Trade Mark) aluminum-silicon piston alloy 21 at 770° C. was poured into the die 20 (FIG.2(*a*)). A load of 25 tonnes was then applied to the molten alloy with a male die punch 22, causing the alloy 21 to infiltrate the porous surface layers 19 of the body 16. The pressure was maintained until solidification was complete. Sections through the piston blank 23 taken subsequently revealed the cavity 17 to be free of LO-EX and the surface regions 19 to be completely impregnated. FIGS. 3(*a*) to 3(*c*) show three examples of alternative cavity geometries which could be employed with a piston combustion bowl 30. FIG. 3(*a*) shows a cavity 32 formed in a body 34 from a ferrous powder having an asymmetric ring contained therein. After sintering, the volume 36 adjacent the cavity 32 becomes sealed by infiltration. The body 34 is incorporated into the piston crown by squeeze-casting of an aluminum alloy into the residual porosity. FIG. 3(*b*) has cavities 40, 42 formed by a disc and an annular element used simultaneously. FIG. 3 (*c*) has a cavity 44 formed from a cylindrical element.

FIGS. 4 (*a*) to 4 (*c*) show portions of annular piston ring carrier inserts 50 made from stainless steel powder and having various alternative cavity geometries 52. These are also incorporated into a piston by a pressure casting technique. The site of the actual piston ring groove is denoted by the dashed line 54.

Although the invention has been described with reference to pistons it will be appreciated that the invention may be applied to many articles where a cavity is required, even where it is not necessary for the cavity to be completely enclosed. Examples of such articles may include heat exchangers, components with integral lubrication systems, multiple nozzle gas burners and manifolds for fluids, for example.

The steps of die pressing described above may be replaced with isostatic pressing of powder around a shaped element.

The cavity containing body may of course be further processed by machining prior to incorporation into a subsequent article.

I claim:

1. A method of forming a piston containing a cavity, the method comprising the steps of incorporating an element having substantially the desired shape of said cavity within a ferrous powder mass, compacting the powder mass to a desired density to form a porous body, heating the porous body at a temperature greater than the melting temperature of the contained element such that at least the porous body adjacent said element becomes infiltrated with and sealed by the material of the element to produce a sealed, residual cavity in the body and to leave the remainder of the body porous, and then incorporating said cavity-containing body into a piston by a pressure casting technique to infiltrate at least part of the remainder of the body.

2. A method according to claim 1 wherein said element is formed from powder.

3. A method according to claim 2 wherein said powder is copper or a copper-based alloy.

4. A method according to claim 1 wherein said cavity-containing body comprises the crown region of the piston.

5. A method according to claim 1 wherein said cavity-containing body comprises a piston ring carrier insert.

* * * * *